US009079636B1

(12) United States Patent
Arnall

(10) Patent No.: US 9,079,636 B1
(45) Date of Patent: Jul. 14, 2015

(54) CLAMP FOR GUNWALES OF FIBERGLASS HULLS

(71) Applicant: Randall E. Arnall, Springfield, MO (US)

(72) Inventor: Randall E. Arnall, Springfield, MO (US)

( * ) Notice: Subject to any disclaimer, the term of this patent is extended or adjusted under 35 U.S.C. 154(b) by 278 days.

(21) Appl. No.: 13/775,893

(22) Filed: Feb. 25, 2013

Related U.S. Application Data

(63) Continuation-in-part of application No. 13/065,460, filed on Mar. 22, 2011, now Pat. No. 8,381,372.

(60) Provisional application No. 61/689,873, filed on Jun. 14, 2012, provisional application No. 61/340,824, filed on Mar. 22, 2010.

(51) Int. Cl.
*B63B 17/00* (2006.01)
*B25B 3/00* (2006.01)

(52) U.S. Cl.
CPC .. *B63B 17/00* (2013.01); *B25B 3/00* (2013.01)

(58) Field of Classification Search
CPC ..... B25B 3/00; B25B 1/24688; B25B 5/067; B25B 5/082
USPC ..... 269/6, 3, 95, 143, 249; 29/276
See application file for complete search history.

(56) References Cited

U.S. PATENT DOCUMENTS

| | | | | |
|---|---|---|---|---|
| 746,504 | A | 12/1903 | Hardy et al. | 81/143 |
| 1,006,057 | A | 10/1911 | Brown | 81/143 |
| 1,061,876 | A | 5/1913 | Showalter | 81/139 |
| 1,155,278 | A | 9/1915 | Rush | 81/143 |
| 1,169,750 | A | 1/1916 | Walsh | 81/143 |
| 1,367,456 | A | 2/1921 | Brown | 81/143 |
| 1,609,330 | A | 12/1926 | Thibodeau | 440/103 |
| 1,988,240 | A | 1/1935 | Ellis | 269/220 |
| 2,026,001 | A | 12/1935 | Hamilton | 81/357 |
| 2,114,227 | A * | 4/1938 | Kriss | 269/145 |
| 2,253,895 | A | 8/1941 | Denovich | 81/139 |
| 2,504,721 | A | 4/1950 | Ortoman | 81/138 |
| 2,650,788 | A | 9/1953 | Hulstein | 248/231.71 |
| 2,882,774 | A | 4/1959 | Guttfeld | 81/139 |
| 3,124,330 | A | 3/1964 | Robinson | 248/228.2 |
| 3,745,329 | A | 7/1973 | Runey, Jr. | 362/209 |
| 3,792,829 | A | 2/1974 | Fickett | 248/354 |
| 4,352,668 | A | 10/1982 | Beevers et al. | 114/344 |
| 4,528,768 | A | 7/1985 | Anderson | 43/21.2 |
| 4,672,898 | A | 6/1987 | Davidson | 108/6 |
| 4,674,798 | A | 6/1987 | Oeth et al. | 297/411.36 |
| 4,786,022 | A | 11/1988 | Grieshaber | 248/287.1 |
| 4,836,127 | A | 6/1989 | Wille | 114/343 |
| 4,993,346 | A | 2/1991 | Rupp | 114/255 |
| 5,222,420 | A | 6/1993 | Sorensen et al. | 81/487 |
| 5,389,466 | A | 2/1995 | Inoue et al. | 429/178 |
| 5,492,258 | A | 2/1996 | Brunner | 224/321 |
| 5,494,553 | A * | 2/1996 | Colucci | 156/580 |

(Continued)

*Primary Examiner* — Lee D Wilson
(74) *Attorney, Agent, or Firm* — Jonathan A. Bay

(57) ABSTRACT

A clamp for fiberglass boats is adjustable where the contact points are on any of the fiberglass hull, the fiberglass deck (which meets the hull at a seam covered by a rub rail), and/or the fiberglass gunwale (which is part of the deck and, if low enough, is called a toe rail). The clamp has an outer jaw for contacting the hull below the rub rail, and inner jaw that is reached over and around the gunwale for contacting the deck inside the gunwale, an optional auxiliary jaw for contacting the outside of the gunwale, and an optional stand-off resting on the crown of the gunwale. Preferably the jaws and stand-off are the terminations of linkages which can be re-configured in an indefinite variety of re-configurations.

18 Claims, 5 Drawing Sheets

(56) References Cited

U.S. PATENT DOCUMENTS

| | | | | |
|---|---|---|---|---|
| 5,513,838 | A * | 5/1996 | Van Rossum | 269/203 |
| 5,832,793 | A | 11/1998 | Collins | 81/138 |
| 5,845,885 | A | 12/1998 | Carnevali | 248/118.1 |
| 6,474,632 | B1 | 11/2002 | Liou | 269/6 |
| 6,561,471 | B1 | 5/2003 | Hawie | 248/201 |
| 7,063,297 | B2 | 6/2006 | Jopling | 248/292.12 |
| 7,077,711 | B1 | 7/2006 | Moore | 439/864 |
| 7,603,960 | B1 | 10/2009 | Perry et al. | 114/364 |
| 7,909,314 | B2 * | 3/2011 | Roesch et al. | 269/6 |
| 7,934,711 | B2 * | 5/2011 | Wong | 269/45 |
| 8,226,074 | B1 * | 7/2012 | Hughey | 269/155 |
| 8,844,917 | B2 * | 9/2014 | Buske | 269/143 |

* cited by examiner

CLAMP FOR GUNWALES OF FIBERGLASS HULLS

CROSS-REFERENCE TO PROVISIONAL APPLICATION(S)

This application claims the benefit of U.S. Provisional Application No. 61/689,873, filed Jun. 14, 2012.

This application is also a continuation-in-part of U.S. patent application Ser. No. 13/065,460, filed Mar. 22, 2011, which claims the benefit of U.S. Provisional Application No. 61/340,824, filed Mar. 22, 2010.

BACKGROUND AND SUMMARY OF THE INVENTION

The invention relates to a gunwale clamp for boating accessories and, more particularly, to a clamp for gunwales of fiberglass boats such that the clamping and releasing (eg., the un-clamping) of the inventive clamp does not scratch or otherwise mar the surface finish of the fiberglass.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

FIG. 3 is an outboard perspective thereof; wherein,

DETAILED DESCRIPTION OF THE PREFERRED EMBODIMENTS

Figure 1:
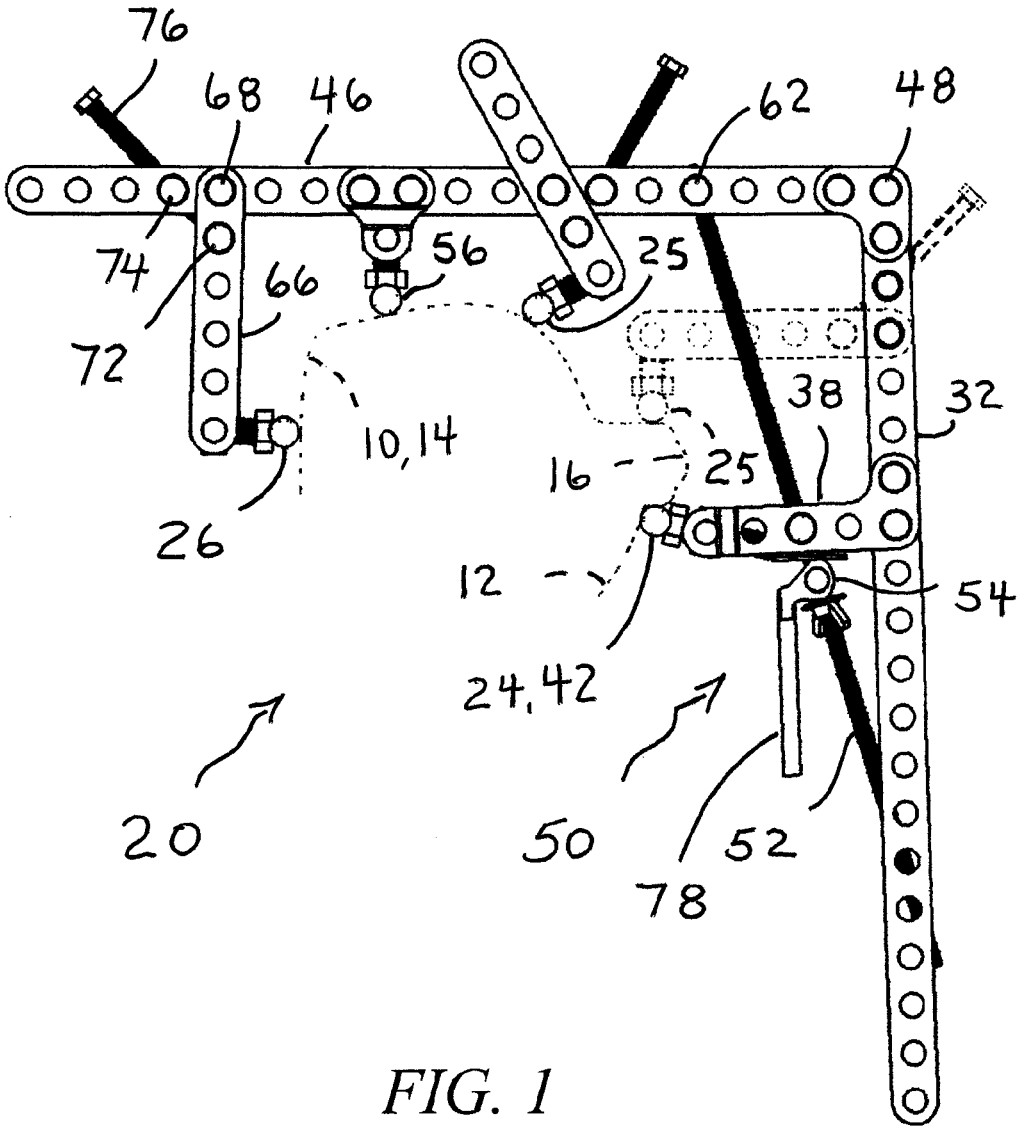
FIG. 1 is a side elevational view of an adjustable clamp in accordance with the invention for clamping around the gunwales of fiberglass boat hulls such that the clamping and releasing (eg., the un-clamping) of the inventive clamp does not scratch or otherwise mar the surface finish of the fiberglass.
Figure 2:
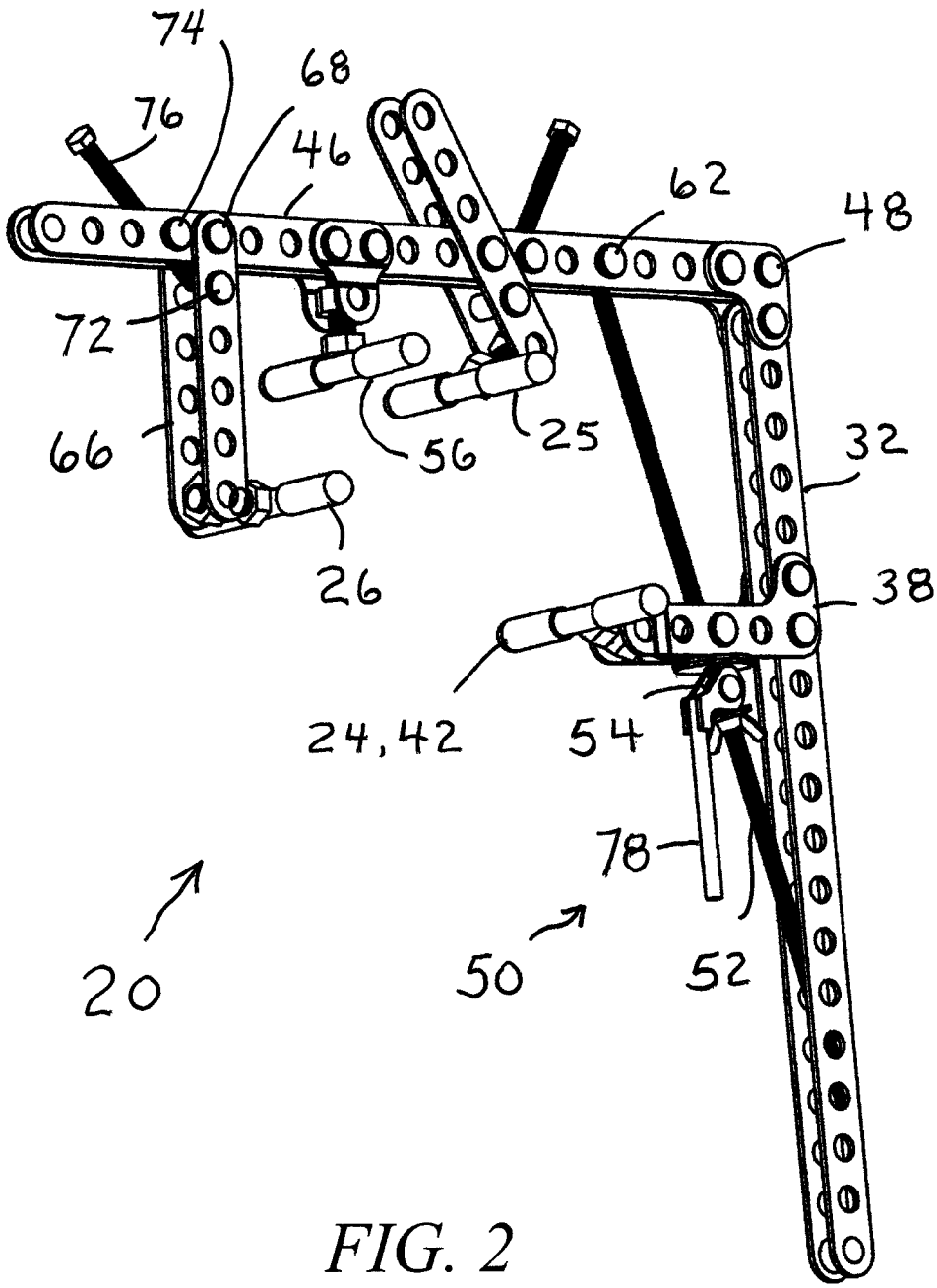
FIG. 2 is an inboard perspective thereof.
Figure 3:
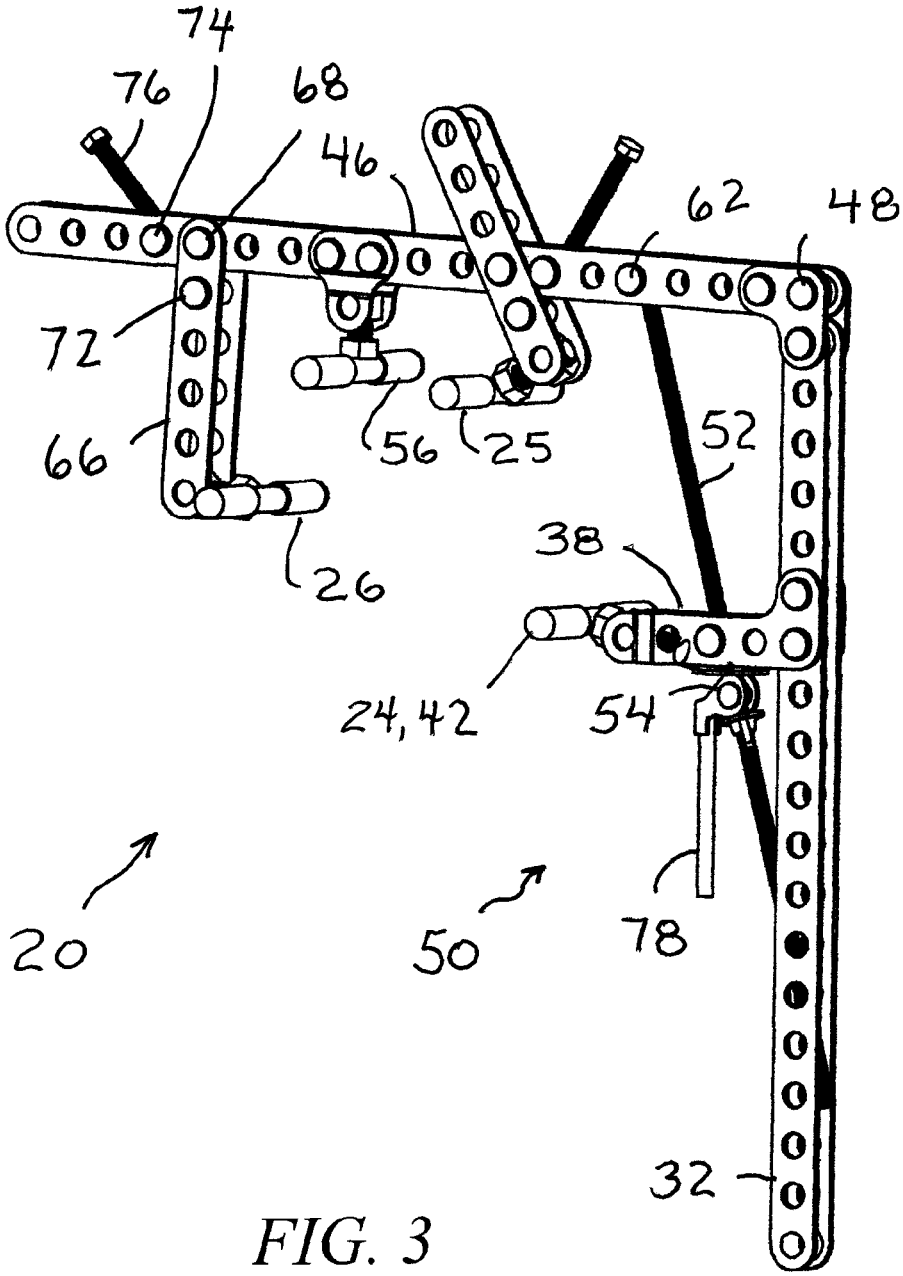

FIGS. 1 through 3 show a first embodiment of an adjustable clamp 20 in accordance with the invention for clamping around the gunwales 10 of fiberglass boats 12,14 such that the clamping and releasing (ie., the un-clamping) of the inventive clamp 20 does not scratch or mar the exterior finish of the fiberglass.

Fiberglass 12,14 boats are made in versions with planing hulls 12. The commonest freshwater examples are bass boats and runabouts. Such fiberglass boats 12,14 comprise a two-piece construction, namely: —a fiberglass hull 12 joined to a fiberglass deck 14 (sometimes referred to as top deck) at a seam. The hull 12 comprises a tub-shape having a sidewall (usually an outwardly flaring sidewall) that terminates in a rim edge. The top deck 14 usually forms a continuation of the sidewall for a short elevation above the rim edge of the hull before turning in then down at a shoulder typically called a 'gunwale' 10.

In bass boats, the term 'gunwale' is sometimes replaced with an alternate term, toe rail. That is, the counterpart gunwale structure in a bass boat is low compared to the floor, and hence the gunwale is sometimes referred to as toe rail.

The seam between the hull 12 and deck 14 is typically covered by a rub rail 16. Typically, the rub rail 16 accepts fasteners through it and into both the hull 12 and deck 14. The fasteners through the rub rail 16 into the hull 12 and deck 14 provides some of the mechanical joining of the hull 12 and deck 14 across the seam. The rub rail 16 is usually also the mount for a rubbery strip that serves as a fender. The rubber strip can also be arranged to cover the heads of the fasteners as well.

Again, the gunwale 10 comprises a raised rail 16 that extends peripherally around the outer edge of the deck 14. Typically the gunwale 10 in these kinds of fiberglass boats is hollow, comprising an inverted channel shape. Sometimes the inverted-channel has an inverted square-U shape, other times and inverted rounded-U shape. Nevertheless, such gunwales 10 can be reckoned as comprising an inboard flange portion and outboard flange portion joined by a crown web portion.

The gunwale 10 gives both structural stiffness to the deck 14 as well as serves as a sort of a curb or wall to prevent items or passengers from easily falling out of the boat. The outboard flange portion terminates in a lower edge, and it is this lower edge which meets the hull 12.

The hulls of bass boats and runabouts are characterized by flare in the sidewalls of the hull 12 (not shown). Generally, the sidewalls of the hull 12 are those portions that are above the hard chine (not shown), in contrast to the bottom of the hull (also not shown), which is below. That is, as the hull 12 terminates in its upper edge, just where it meets the lower edge of the gunwale 10's outboard edge, the flare is the outward-spreading of the sidewall of the hull 10 in the upward direction, when looked at in cross-section. This flare provides several things. When crashing waves, the flare throws spray away from the passenger compartment. The flare also provides for an expanded deck 14 for the same amount of hull 12 below the chine.

Flare is in contrast to flam. Flam is where the cross-section of the hull is perhaps semi-circular, maybe even parabolic or the like (not shown). In any event, flam is more characteristic of displacement hulls, especially sail boats.

The fiberglass in fiberglass boats 12, 14 is typically given a smooth exterior finish that can be elaborately ornamented with lively colors and/or metal flake and so on. This smooth exterior finish typically comprises a gel coat layer. It is an object of the invention to clamp around a gunwale 10 of a fiberglass boat 12,14 without scratching or otherwise marring the exterior finish of the fiberglass.

Again, FIGS. 1 through 3 show a first embodiment of an adjustable clamp 20 in accordance with the invention for securing across the gunwales 10 of fiberglass boats 12,14 (and in contrast to pontoon-boat rails, eg., pontoon boats don't formally have gunwales, but they have counterparts, which are typically square or rectangular aluminum tubes).

The adjustable clamp 20 comprises an outer jaw 24 in opposition to an inner jaw 26, and an optional auxiliary jaw 25 for connecting to either the inner or outer jaw 26 or 24 as desired. In FIG. 1, a first optional position for the auxiliary jaw 25 is shown in solid lines and is shown attached to the inner 26. A second optional position for the auxiliary jaw 25 is shown in dashed lines and is shown connected to the outer jaw 24. The inner jaw 26 is tightened relative to the outer jaw 24 by a screw assembly 50 in the style of a hand vise. The inner and outer jaws 26 and 24 are furthermore articulated (eg., jointed within themselves and not relative to any other jaw) with linkages as more particularly described below.

The outer jaw 24 comprises an inner link 32 and an outer link 38. The connection between the outer link 38 and inner link 32 is optionally perpendicular. Preferably, the connection between the inner and outer links 32 and 38 is adjustable such that the effective lengths of either of the inner link 32 or outer link 38 lies between elongated and foreshortened extremes. Optionally the links 32 and 38 can be constructed of spaced pairs of apertured bar stock to allow relatively easy re-configuring and adjustment relative to each other by pins or fasteners and the like. The outer link 38 preferably terminates in longitudinally elongated padded or grippy ends 42 utilized to contact the hull 12. The wide grip pads 42 give the clamp 20 stability in the fore to aft direction. The grip pads 42 protect against scratching or marring the finish or the gel coat of the fiberglass hull 12, as well as scratching the rub rail 16.

FIG. 1 shows that the outer jaw 24's padded ends 42 should preferably contact the hull 12 below the rub rail 16 or, more preferably still, just underneath the rub rail 16.

The inner jaw 26 comprises an inner link 46 and outer link 66. Optionally the inner and outer links 46 and 66 for the inner jaw 26 comprise spaced pairs of apertured bar stock. The inner links 32 and 46 of the outer and inner jaws 24 and 26 are respectively connected together by a threesome of pins (bolts) 48 which relatively fix the connection between the inner links 32 and 46 of the outer and inner jaws 24 and 26 respectively in a relatively fixed alignment. Such alignment is preferably an approximately perpendicular alignment.

The screw assembly 50 provides for the squeeze between the jaws 24 and 26. The screw assembly 50 optionally comprises a threaded-rod 52 (eg., all thread) with a cam nut 54 for quick manual and tool-free clamping and release of the inventive clamp 20. The screw assembly 50 interconnects between the inner link 46 of the inner jaw 26 and outer link 38 of the outer jaw 24. As FIG. 1 shows better, the inner link 46 of the inner jaw 26 furthermore carries a stand-off 56 for standing the inner jaw 26's inner link 46 off the crown or web portion of gunwale 10. The stand-off 56, like the outer jaw 24's hull-contacting forked end 38, has a hull-contacting T-end that is covered in rubber pads.

The screw assembly 50's threaded rod 52 is axially-confined on the inner jaw 26's inner link 46 by a pin or bolt 62.

To turn to the inner jaw 26's outer link 66, the outer link 66 is pinned to inner link 46 by a pivot pin (eg., a bolt) 68. The inner and outer links 46 and 66 of the inner jaw 26 are variously adjustable relative to each other by moving the pin 68 around in various different ones of the apertures of the apertured bar stock. The spaced bars of the inner link 46 flank a central collar (not shown), and the spaced bars of the outer link 66 flank the pair of bars of the inner link 46 (however, this arrangement could be readily reversed). The outer link 66 terminates in a T-end that is covered in gel-coat protecting pads. Again, bass boats have such low gunwales relative to the deck floor that the gunwales are sometimes alternatively referred to as toe rails. Given a bass boat deck (not shown), preferably the outer link 66's T-end nests in the crease between the gunwale's inboard flange and the deck's floor.

The outer link 66 includes a socket 72 for a strut 76. The socket 72 is formed in or attached close to the T-end of the inner jaw 26's outer link 66. The strut 76 is pivotally connected to the inner link 46 by cross-wise dowel nut 74. The dowel nut spans between the spaced bars of the inner link 46. The dowel nut 74 comprises a short section of round bar with a threaded hole bored through perpendicular to the axis of the round bar. The attachment point on the inner link 46 for the dowel nut 74 is inboard of the attachment point on the inner link 46 for the outer link 66.

The strut 76 optionally comprises a lag bolt. The strut 76 is threaded through the threaded-aperture of the dowel nut 74, between the spaced bars of the inner link 46, with the dowel nut pivotally caged in a pair of opposite apertures. The strut 76 threads through the dowel nut 74 until the strut 76's end opposite the nut end is jammed in the socket 72 for the strut 76. Among other things, the dowel nut 74 allows the strut 76 to pivot freely relative to the inner link 46.

FIG. 1 allows reckoning that, the clamp 20 in accordance with the invention clamps tight over the gunwale 10 by a user handling the lever 78 of the cam nut 54 on the screw assembly 50. It can be noticed in this view that the strut 76 axially opposes the outer jaw 24's hull-contacting ends 42 more on the same line than the line of the inner jaw 26's outer link 66. Hence the strut 76 assists in the squeeze on the deck 14 and hull 12 coming from two opposite directions on a diagonal line.

The clamp 20 in accordance with the invention optionally comprises an auxiliary jaw 25 for either the inner jaw 26 or outer jaw 24. The auxiliary jaw 25 preferably connects optionally to the inner link 46 of the inner jaw 26 (as shown in solid lines) or else to the inner link 32 of the outer jaw 24 (as shown in dashed lines in FIG. 1), but necessarily exclusively in the positions as illustrated. The auxiliary jaw 25 preferably comprises a construction like the outer link 66 of the inner jaw 26, including its own pivot pin and axially adjustable threaded strut. That way, the auxiliary jaw 25 can be tightened independently of inner or outer jaws 26 and/or 24.

FIG. 1 shows a non-exclusively preferred relation between the inner jaw 26 and auxiliary jaw 25, wherein the inner jaw 26 contacts the deck 14 on the inboard side of the gunwale 10, while the auxiliary jaw 25 contacts the outboard side of the gunwale 10 (and not the hull 12, which is below the rub rail 16). Again, the auxiliary jaw 25 can be connected to either of the inner links 46 and 32 of the inner or outer jaw 26 or 24, respectively, to do this. The auxiliary jaw 25 preferably has a T-end covered in pads for contacting the gunwale as shown.

The adjustable clamp 20 in accordance with the invention affords quick connection and disconnection to and from the gunwale 10 a fiberglass boat 12,14 and thereafter serves as a base on which to mount any number of various, interchangeable accessories. Non-limiting examples thereof include without limitation (none which are shown): —a fish locator display (as mounted on the top of the inner jaw 26); a fish locator transducer (as hung from the bottom of the outer jaw 24); rod holder (s); rod storage; drink holder(s); an arch system for boat covers; a pole system for any of a Bimini, canopy, sun shade, or rain shield; a frame system for either a tent or duck blind; oar locks; bow and/or stern lights; bait bucket(s); lantern(s); black light(s); bumper(s); and so on.

Figure 4:
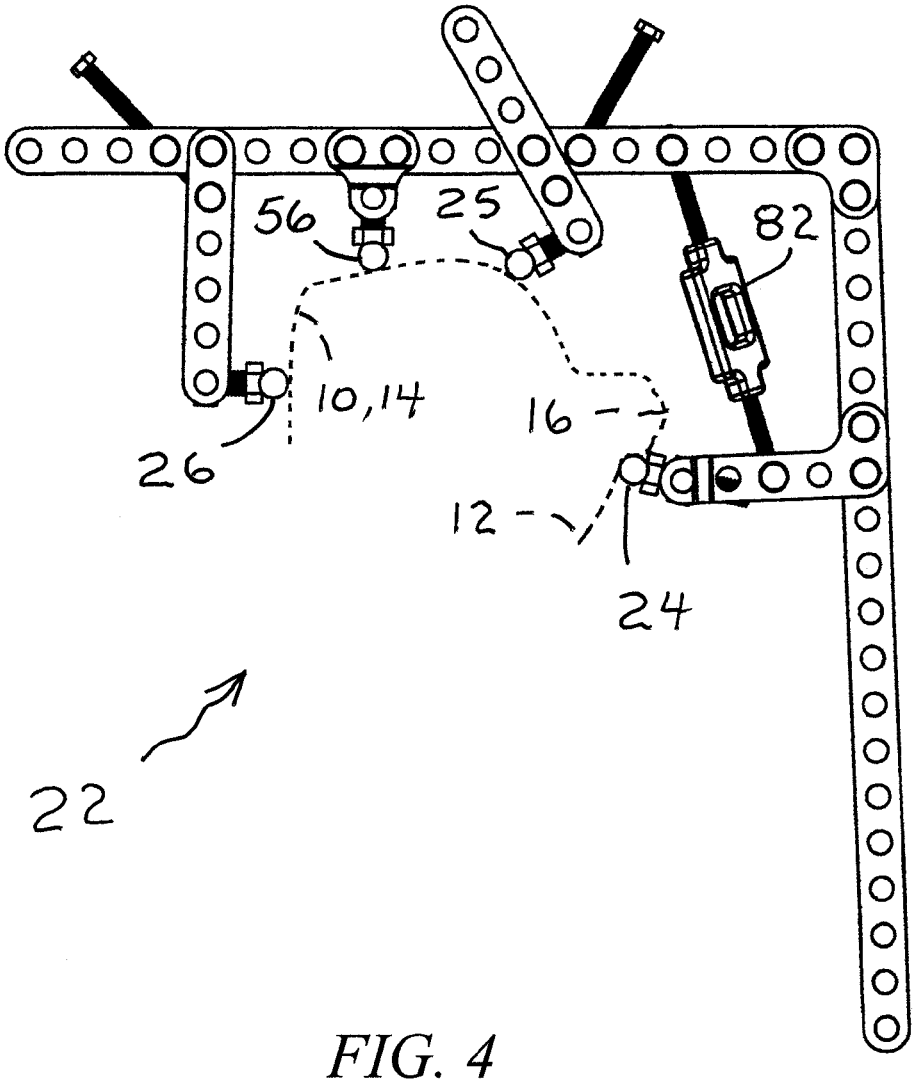
FIG. 4 is a side elevational view comparable to FIG. 1 except of an alternate embodiment of such an adjustable clamp in accordance with the invention, and for clamping around the gunwales of fiberglass boat hulls such that the clamping and releasing (ie., the un-clamping) thereof does not mark the hull.
Figure 5:
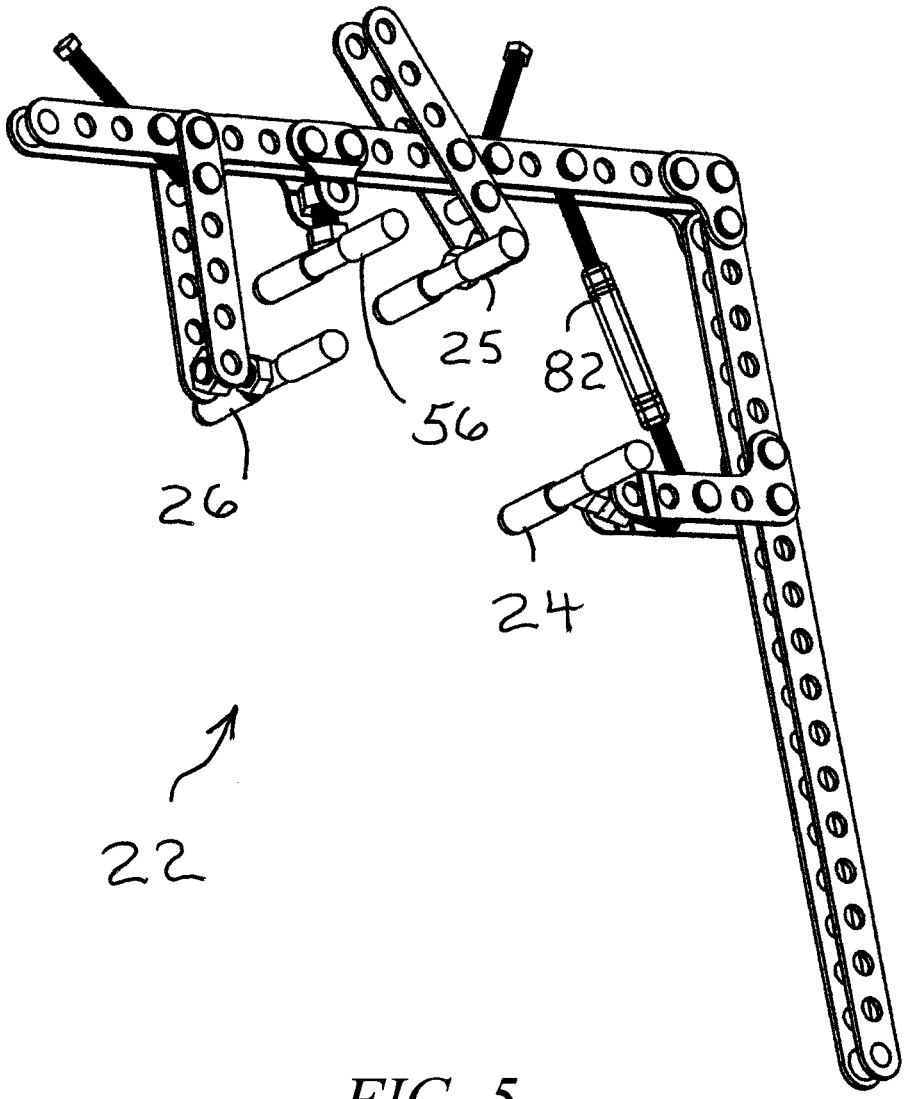
FIG. 5 is an inboard perspective thereof.

FIGS. 4 and 5 show an alternate embodiment of a clamp 22 in accordance with the invention. The threaded-rod screw assembly 50 of FIGS. 1-3 has been replaced by a turnbuckle screw 82.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. An adjustable clamp, comprising:

an inner jaw and a link therefor an outer jaw and a link therefor, a connection between inner jaw link and outer jaw link, and a clamping mechanism connected between the links of the inner and outer jaws, respectively, for reversibly driving the inner and outer jaws in clamping pressure relative each other;

wherein the links and clamping mechanism are shaped and adapted to reach around a fiberglass gunwale of a fiberglass hull boat such that the inner jaw contacts an inboard wall of the gunwale and the outer jaw contacts the hull on the outboard surface;

an elongate guide pinned to one of the inner jaw link or outer jaw link;

a backing surface that applies the clamping pressure to the other of the outer jaw link or inner jaw link;

a levered cam threaded onto the elongate guide external to the backing surface;

an adjustable locking provision for locking on the elongate guide at fixed positions therealong said one guide with the levered cam, and sandwiching the levered cam between said adjustable locking provision and the backing surface;

wherein the levered cam has a cam head with an over-center axis such that, when rolled on one side of the over-center axis the clamp is slack and adapted to position the jaws on opposite sides of an object to be clamped, and, when rolled over the other side of the over-center axis the jaws clamp tight on said object, whereby the over-center axis prevents the cam head from auto-pivoting back across the over-center axis in the absence of a user-applied external force.

2. The adjustable clamp of claim 1 wherein:

the inner jaw link comprises portions proximate the connection that are elongate along a first axis;

the outer jaw link comprises portions proximate the connection that are elongate along a second axis; and the connection pins the elongate portions of the inner jaw link and outer jaw link in a fixed angle;

whereby flexure in the elongate portions of the inner jaw link and outer jaw link that results when the clamping pressure is applied biases the cam head to one side of the over-center axis or the other side, but not stably axially aligned on the over-center axis.

3. An adjustable clamp, comprising:

an inner jaw and a link therefor an outer jaw and a link therefor, a connection between inner jaw link and outer jaw link, and a clamping mechanism connected between the links of the inner and outer jaws, respectively, for reversibly driving the inner and outer jaws in clamping pressure relative each other;

wherein the links and clamping mechanism are shaped and adapted to reach around a fiberglass gunwale of a fiberglass hull boat such that the inner jaw contacts an inboard wall of the gunwale and the outer jaw contacts the hull on the outboard surface;

the inner jaw link comprises portions proximate the connection that are elongate along a first axis;

the outer jaw link comprises portions proximate the connection that are elongate along a second axis; and the clamping mechanism is elongated along a third axis;

wherein the third axis is acute to one of the first or second axis and obtuse vice versa; and wherein the clamping mechanism is adjustably connected between the links of the inner and outer jaws, respectively, for varying the angle subtended between the third axis and either the first or second axis among a range between acute and obtuse extremes.

4. The adjustable clamp of claim 3 wherein:

the clamping mechanism comprises an elongate member and a manually-operable adjustable locking provision.

5. The adjustable clamp of claim 4 wherein:

the clamping mechanism comprises a turnbuckle and threaded rod.

6. The adjustable clamp of claim 3 wherein:

the inner jaw link comprises a plurality of links including an outer link proximate the inner jaw and an inner link proximate the connection;

the outer jaw link comprises a plurality of links including an outer link proximate the outer jaw and an inner link proximate the connection.

7. The adjustable clamp of claim 6 wherein:

the inner jaw's inner link comprises portions proximate the connection that are elongate along a first axis;

the outer jaw's inner link comprises portions proximate the connection that are elongate along a second axis; and the connection pins the inner jaw's inner link and outer jaw's inner link in a fixed angle.

8. The adjustable clamp of claim 7 wherein:

one of the inner jaw's outer link or outer jaw's outer link is elongate along a separate axis and is pivotably pinned to the respective inner link of the inner jaw or outer jaw, respectively, and, further comprising an adjustable mechanism for adjustably fixing an angle subtended between the separate axis of the one of the inner jaw's outer link or outer jaw's outer link, and, the first or second axis respectively of the respective inner link of the inner jaw or outer jaw, respectively.

9. The adjustable clamp of claim 7 wherein:

the other of the outer jaw's outer link or inner jaw's outer link is elongate along a furthermore separate axis and is movably fixable along the respective first or second axis of the inner link of the outer jaw or inner jaw, respectively.

10. The adjustable clamp of claim 7 wherein:

the fixed angle fixed by the connection between the inner jaw's inner link and outer jaw's inner link comprises a right angle; and the other of the outer jaw's outer link or inner jaw's outer link is elongate along a furthermore separate axis and is movably fixable along the respective first or second axis of the inner link of the outer jaw or inner jaw, respectively, and subtends angles thereto that comprise right angles as well.

11. The adjustable clamp of claim 6 wherein:

the inner jaw's inner link comprises portions proximate the connection that are elongate along a first axis;

the outer jaw's inner link comprises portions proximate the connection that are elongate along a second axis; and further comprising, an auxiliary jaw and elongate link therefor;

said auxiliary jaw being disposed intermediate the inner and outer jaws;

said elongate link for the auxiliary jaw being connected to one or the other of the inner links for the inner or outer jaws, respectively.

12. The adjustable clamp of claim 11 wherein:

the elongate link for the auxiliary jaw is selectively connectable to both the inner link for the inner jaw for one circumstance, or alternatively, to the inner link for the outer jaw for another circumstance.

13. The adjustable clamp of claim 12 wherein:

the one circumstance comprises disposing the auxiliary jaw to contact the top of the gunwale; and the other circumstance comprises disposing the auxiliary jaw to contact an outboard wall of the gunwale.

14. The adjustable clamp of claim 12 wherein:

the auxiliary jaw is disposed to contact the gunwale on either the top or outboard side thereof; and the outer jaw is disposed to contact the hull below the seam between the hull and top deck, which includes the gunwale.

15. The adjustable clamp of claim 14 wherein:

the auxiliary jaw and the outer jaw are disposed to flank the rub rail.

16. The adjustable clamp of claim 11 wherein:

said elongate link for the auxiliary jaw is adjustably connected to one or the other of the inner links for the inner or outer jaws, respectively, for varying the length thereof between extended and foreshortened extremes.

17. The adjustable clamp of claim 11 wherein:

said elongate link for the auxiliary jaw is adjustably connected to one or the other of the inner links for the inner or outer jaws, respectively, for pivoting the angle therebetween among a range between acute and obtuse extremes.

18. An adjustable clamp, comprising:

an inner jaw and a link therefor an outer jaw and a link therefor, a connection between inner jaw link and outer jaw link, and a clamping mechanism connected between the links of the inner and outer jaws, respectively, for reversibly driving the inner and outer jaws in clamping pressure relative each other;

wherein the links and clamping mechanism are shaped and adapted to reach around a fiberglass gunwale of a fiberglass hull boat such that the inner jaw contacts an inboard wall of the gunwale and the outer jaw contacts the hull on the outboard surface;

a stand-off connected to the link for the inner jaw for contacting and spacing said inner jaw link off the top of the gunwale.

* * * * *